United States Patent [19]

Awad

[11] Patent Number: 5,064,500

[45] Date of Patent: Nov. 12, 1991

[54] SURFACE CONDITIONER FOR FORMED METAL SURFACES

[75] Inventor: Sami B. Awad, Drexel Hill, Pa.

[73] Assignee: Henkel Corporation, Ambler, Pa.

[21] Appl. No.: 583,051

[22] Filed: Sep. 14, 1990

Related U.S. Application Data

[63] Continuation-in-part of Ser. No. 492,695, Mar. 13, 1990, which is a continuation-in-part of Ser. No. 395,620, Aug. 18, 1989, Pat. No. 4,944,889, which is a continuation-in-part of Ser. No. 57,129, Jun. 1, 1987, Pat. No. 4,859,351.

[51] Int. Cl.[5] ..... B44C 1/22; C23F 1/00; C09K 13/04

[52] U.S. Cl. ..... 156/665; 134/3; 148/6.27; 252/79.4; 252/32.5; 252/142

[58] Field of Search ..... 156/656, 665; 134/3, 134/41; 252/79.2, 79.4, 79.5, 32.5, 52 R, 56 R, 142; 148/6.27

[56] References Cited

U.S. PATENT DOCUMENTS

| | | | |
|---|---|---|---|
| 3,964,936 | 6/1976 | Das | 148/6.27 |
| 4,148,670 | 4/1979 | Kelly | 148/6.15 |
| 4,859,351 | 8/1989 | Awad | 252/32.5 |
| 4,944,889 | 7/1990 | Awad | 252/32.5 |

*Primary Examiner*—William A. Powell

*Attorney, Agent, or Firm*—Ernest G. Szoke; Wayne C. Jaeschke; Norvell E. Wisdom, Jr.

[57] ABSTRACT

Contact of acid or alkaline cleaned aluminum surfaces, particularly cans, with a water based composition containing a combination of (i) alkoxylated phosphate esters, (ii) ions of aluminum, zirconium, iron, tin, and/or cerium, (iii) a metal etching component, and (iv) a combination of alkoxylated alcohol and alkoxylated alkyl phenol emulsifiers, gives the surface after drying lowered surface friction without loss of high quality printability and lacquer adhesion and removes any brown spotting on the cans that may have developed during the cleaning or post-cleaning rinses. The cans after treatment are substantially free from any water breaks when rinsed with water. The foaming resistance and storage stability of the water based composition as described above, and of other similar surface friction reducing treatments for aluminum containers, may be advantageously increased by adding a biocidal agent, preferably hydrogen peroxide, and a combination of liquid paraffin, solid wax, and a high molecular weight fatty acid derivative(s) as antifoam agent.

20 Claims, No Drawings

SURFACE CONDITIONER FOR FORMED METAL SURFACES

CROSS REFERENCE TO RELATED APPLICATIONS

This application is a continuation-in-part of copending application Ser. No. 492,695 filed Mar. 13, 1980, which was a continuation-in-part of copending application Ser. No. 395,620 filed Aug. 18, 1989 (now U.S. Pat. No. 4,944,889), which was a continuation-in-part of application Ser. No. 57,129 filed June 1, 1987 (now U.S. Pat. No. 4,859,351). The entire content of the specification of U.S. Pat. No. 4,859,351 is hereby incorporated herein by reference. This patent is generally referred hereinafter as "the '351 patent" for brevity. All parts of the specification of application Ser. No. 395,620 filed Aug. 18, 1989 that are not duplicated in U.S. Pat. No. 4,859,351 are also hereby incorporated herein by reference.

BACKGROUND OF THE INVENTION

1. Field of the Invention

In addition to the general field given in the '351 patent, one embodiment of this invention is particularly directed to compositions, and processes for using them, that produce a treated formed metal surface that is substantially or entirely free from "water breaks" when wet, or in other words, a surface over which any water present on the surface spreads spontaneously. Another embodiment of this invention is particularly directed toward aqueous compositions suitable for contacting formed metal surfaces to deposit thereon after drying a mobility enhancing lubricant film, said compositions being protected against deterioration from the action of microorganisms during storage and/or against foaming during use.

STATEMENT OF RELATED ART

In addition to the art already of record in the '351 patent, U.S. Pat. No. 4,148,670 of Apr. 10, 1979 to Kelly teaches a conversion coating solution for aluminum containing compounds of zirconium and/or titanium, fluoride, and phosphate, and optionally also polyhydroxy compounds, in dissolved form. The phosphate taught is conventional inorganic phosphate, and no mobility enhancing benefit obtained by the treatment is taught.

U.S. Pat. No. 3,964,936 of June 22, 1976 to Das teaches a conversion coating solution for aluminum which produces a surface that maintains its shiny appearance and resists discoloration even when treated with boiling water. The coating solution contains compounds of zirconium and fluorine and may also contain boric acid. No use of a phosphorus containing component is taught, nor is any mobility enhancement from the treatment.

DESCRIPTION OF THE INVENTION

In this description, except in the claims and the operating examples or where explicitly otherwise indicated, all numbers describing amounts of ingredients or reaction conditions are to be understood as modified by the word "about" in defining the broadest scope of the invention. Operation within the exact numerical limits specified is generally preferred. Also, except where otherwise stated, whenever more than one material is stated to be suitable for a particular component of a composition, it is to be understood that mixtures including any two or more of the listed materials are also equally suitable.

It has now been found that a formed aluminum surface, which has been conventionally thoroughly cleaned and degreased by sufficient contact with a water based acid or alkaline cleaner, can be effectively and advantageously surface conditioned so as to impart increased mobility, i.e., a lower coefficient of static surface friction, to the surface when subsequently dried, without harming the reflectivity or printability of, or the adherence of lacquer to, the treated surface, by contacting the surface with a composition comprising, or preferably consisting essentially of, water and the following components:

(A) a component of water soluble materials selected from the group conforming to general chemical formula I:

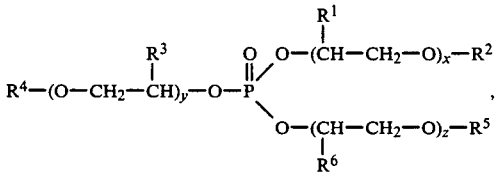

(I)

wherein each of $R^1$, $R^3$, and $R^6$ is independently selected from hydrogen and alkyl groups containing 1–4 carbon atoms, preferably from hydrogen and methyl, most preferably hydrogen; each of x, y, and z is an integer and is independently selected within the range from 0–25; and each of $R^2$, $R^4$, and $R^5$ is independently selected from hydrogen, monovalent cations, monovalent fractions of polyvalent cations, alkyl groups containing 1–20 carbon atoms, and aryl and arylalkyl groups containing 1–20 carbon atoms; except that at least one of $R^2$, $R^4$, and $R^5$ (i) is not hydrogen and (ii) has at least one alkoxyl group bonded between it and the phosphorous atom in the formula;

(B) a component selected from the group of water soluble salts containing ions that comprise atoms selected from the group consisting of Fe, Zr, Sn, Al, and Ce;

(C) a metal etching component, preferably selected from the group consisting of nitric acid, sulfuric acid, phosphoric acid, hydrofluoric acid, hydrochloric acid, hydrobromic acid, hydroiodic acid, acid salts of sulfuric and phosphoric acids, salts of nitric, sulfuric, phosphoric, hydrofluoric, hydrochloric, hydrobromic, and hydroiodic acids with bases having an ionization product constant less than that of the acid with which they form the salt, and mixtures of any of these; and, optionally, (D) a component selected from molecules conforming to general formula II:

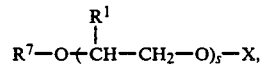

(II)

wherein $R^7$ is a linear, cyclic, or branched saturated monovalent aliphatic hydrocarbon moiety containing from 1 to 25, preferably from 4–20, carbon atoms; X is selected from the group consisting of hydrogen, halogen, phenyl, and $R^1$; is an integer from 1 to 50, preferably from 1 to 20; and $R^1$ has the same meaning as for formula I;

(E) a component selected from molecules conforming to general formula III:

$$R^8-(C_6H_4)-O-(CH(R^1)-CH_2-O)_s-H, \quad \text{(III)}$$

wherein $R^8$ is a linear, cyclic, or branched saturated monovalent aliphatic hydrocarbon moiety containing from 4 to 25, preferably from 8–12, most preferably 9, carbon atoms; $(C_6H_4)$ is an ortho, meta, or para phenylene nucleus; and $R^1$ and s have the same meaning as for formula II;

(F) a component selected from chelating agents for the metal containing ions of component (B), preferably selected from the group consisting of molecules, including polymer molecules, each containing at least two moieties selected from group consisting of amino, substituted amino, carboxyl, phosphonate, sulfonate, and carbonyl moieties;

(G) a component selected from molecules conforming to general formula IV:

$$R^{10}-C(=O)-O-(CH(R^1)-CH_2-O)_x-H, \quad \text{(IV)}$$

wherein $R^{10}$ is a linear or branched, saturated or unsaturated monovalent aliphatic hydrocarbon moiety containing from 1 to 25, preferably from 4–20, carbon atoms; and $R^1$ and x have the same meaning as in formula I.

It should be noted that not all of the specified components must be separate materials. Fluorozirconic acid (i.e. $H_2ZrF_6$), for example, can serve as both component (B) and component (C).

It is preferable for component (A) to be selected from molecules conforming to formula I when each of x and z is zero and each of $R^2$ and $R^5$ is hydrogen or a cation or cation fraction, and such materials can serve as all of components (A), (B), and (C), for example if $R^2$ is hydrogen and $R^5$ is $(\frac{1}{3})Fe^{+3}$.

It is preferred that the amount of component (A) in a solution used for treating according to this embodiment of this invention be such as to provide a concentration of from 0.00001 to 0.0032 gram atoms of phosphorus per liter, or more preferably from 0.0005 to 0.0015 gram atoms of phosphorus per liter. It is also independently preferred that the amount of component (B) in a solution used for treating according to this embodiment of this invention be such as to provide a concentration of from 0.00001 to 0.01 gram atoms per liter, or more preferably from 0.0001 to 0.003 gram atoms per liter, of the total of all metal atoms recited in component (B).

It is also independently preferred that component (A) be selected from molecules according to formula I when (i) x is either zero or not less than 0.5 the number of carbon atoms in $R^2$; (ii) y is either zero or not less than 0.5 the number of carbon atoms in $R^4$; and (iii) z is either zero or not less than 0.5 the number of carbon atoms in $R^5$.

Irrespective of its detailed composition, the composition with which a formed aluminum surface is contacted during a process according to this embodiment of this invention preferably contains from 0.001 to 10% by weight ("w %"), more preferably 0.005–0.05 w %, of the total of components (A), (B), and (C), as described above, with optional components and water making up the balance. The water used need not necessarily be deionized or otherwise specially purified; ordinary tap water usually gives satisfactory results. The pH of the composition during contact with a formed aluminum surface preferably is in the range of 1–8, more preferably in the range of 2–5. The pH may be adjusted as needed, preferably with nitric and/or sulfuric acid, during use, in order to maintain the pH within the desired range. The temperature of the composition during contact with the formed aluminum surface is preferably from 10°–85° C., more preferably from 21°–54° C. Contact may be by spraying, immersion, or any other convenient method or mixture of methods. Preferably the time of contact is from 5 - 60, more preferably from 20–30, seconds. It is also generally preferable to rinse the treated surface first with tap water and then again with deionized water after treatment according to the invention and before further processing, such as drying, printing, lacquering, or the like.

Independently of all other preferences, it is preferable if a composition according to this embodiment of this invention contains optional components (D) and (E) as defined above in amounts sufficient to prevent or at least substantially reduce any tendency toward gross, visually detectable phase separation that the composition otherwise may have. It has been found that in compositions containing only components (A) through (C) and optionally components (F) and (G) as defined above, a phase enriched in metal content tends to separate from the remainder of the composition after the composition has been in use for some time after make-up. Preferably the ratio by weight of component (D) to component (E) is in the range from 3:1 to 3, or more preferably in the range from 1.7:1 to 1:1.4. Independently, it is preferable if the ratio by weight of the combined components (D) and (E) to component (A) is in the range from 3.3:1 to 1:2, or more preferably in the range from 1.8:1 to 1:1.5.

In addition to a process of treating and the composition used directly for treating, another embodiment of the invention is a concentrate from which the composition to be used for treating can be made by dilution with water. Such a concentrate preferably contains the components (A), (B), (C), and optionally (D), (E), (F), and/or (G) as noted above in an amount of from 30–200 times the w % level noted above for the composition for direct use in treating metal surfaces.

The compositions and methods of these embodiments of this invention have several advantages over those described in the '351 patent:

after treatment according to this invention, a surface can be rinsed many more times with tap or deionized water without losing improved surface mobility and other advantages than can a surface treated according to the examples of the '351 patent;

if there is prolonged contact between the treated surface and a cleaning composition or one of the rinses after cleaning but prior to treatment with a composition according to this invention (as a result of unplanned stoppages of a high speed production line, for example), light-to-deep brown spots, believed to be hydrated aluminum oxide, sometimes form on the treated surface; any such spots are removed by treatment according to this invention, whereas they usually persist after using a process as taught in the examples of the '351 patent;

a process according to this invention may more readily be operated at a pH sufficiently low to inhibit bacterial growth than one according to the examples of the '351 patent;

almost any readily available industrial or tap water supply may be used for makeup or dilution of a composition according to this invention, while that taught in the '351 patent generally needs deionized water for best results;

the surfaces produced by a process according to the present invention are very readily wet by water and thus remain free of "water breaks", which are considered undesirable by most aluminum can processors; cans processed according to the examples of the '351 patent are much more likely to exhibit water breaks.

Another embodiment of the present invention comprises compositions and their use as described explicitly above, and compositions and their use as described in the above referenced application Ser. No. 395,620 and U.S. Pat. No. 4,859,351), which are protected against deterioration from microorganisms during storage and/or use and/or from foaming during preparation and/or use.

Any antimicrobial or biocidal agent, except those having some detrimental effect on the mobility enhancing properties or the stability of the composition, may advantageously be added to the compositions as previously taught herein in an amount sufficient to effectively inhibit the growth of microorganisms. Hydrogen peroxide is generally most preferred for this purpose. In aqueous concentrated compositions, suitable for dilution with about 99 times their own weight of water to make a composition ready for direct application to metal to enhance mobility after drying, as already described, concentrations of hydrogen peroxide in the range from 0.375 to 3.75 w % are preferred, with concentrations in the range from 1.4–2.2 w % most preferred. In more concentrated compositions the preferred biocide concentrations would be determined by the expected degree of dilution of the concentrate. In general, however, because of the relatively low stability of concentrated hydrogen peroxide, it is preferred that this component, if used, be added only to a sufficiently dilute concentrate that the concentration of hydrogen peroxide does not exceed about 3 w %. at the time of making up the composition.

Any antifoam agent, except those which have some detrimental effect on the mobility enhancing properties already described or the stability of the compositions, may advantageously be added to the compositions as previously taught herein, in an amount effective to decrease the amount of foaming observed during preparation and/or use of the compositions. The preferred antifoam agent is a combination of wax, low volatility liquid paraffin hydrocarbons, and high molecular weight fatty acid derivatives. Generally, silicone antifoam agents are not desirable for use with this invention because they tend to cause formation of water breaks. An amount of antifoam agent corresponding to 0.05 to 2 w % is generally preferred, with 0.5–1 w % generally more preferred.

All the advantages of increased mobility, low surface coefficient of friction, high quality printability, and good adhesion of lacquers and the like as taught in the '351 patent are retained for treatments according to this invention.

The practice of this invention may be further appreciated by consideration of the following non-limiting examples.

EXAMPLES

General Conditions for Examples 1–7 and Comparison

In all these examples, the surfaces treated were those of conventional aluminum beverage cans already in their final shape and size. The cans were subjected to an acid prewash in an aqueous solution sulfuric acid having a pH of 2 for 30 seconds ("sec") at 54° C., then to washing with a conventional alkaline, surfactant containing cleaner at pH 12.3 for 60 sec at 54° C., and then to a 30 sec tap water rinse before being treated with a composition according to this invention as set forth in the specific examples below. (The compositions given in the specific examples are for concentrates according to this invention; for treatment, a solution of the w % of the concentrate specified in Table 1, in tap water, was used.) After this treatment, the cans were rinsed first in tap water for 30 sec, then in deionized water for 90 sec, and dried at 210° C. The coefficient of static surface friction on the cans after drying was measured as described in the '351 patent.

EXAMPLE 1

The concentrate for this example had the following composition:

| Ingredient | Parts by Weight in Composition |
|---|---|
| Stannic chloride solution, 25% by weight in water | 300 |
| ETHFAC TM 136 | 400 |
| ETHOX TM MI-14 | 100 |
| Ammonium bifluoride solution, 25% by weight in water | 135 |
| DEQUEST TM 2010 | 25 |
| Water | 9040 |

EXAMPLE 2

The concentrate for this example had the following composition:

| Ingredient | Parts by Weight in Composition |
|---|---|
| Ferric ammonium citrate solution, 25% by weight in water | 300 |
| ETHFAC TM 136 | 400 |
| ETHOX TM MI-14 | 100 |
| Ammonium bifluoride solution, 25% by weight in water | 135 |
| DEQUEST TM 2010 | 25 |
| Water | 9040 |

EXAMPLE 3

The concentrate for this example had the following composition:

| Ingredient | Parts by Weight in Composition |
|---|---|
| Cerium ammonium sulfate | 4 |
| ETHFAC TM 136 | 30 |
| Ammonium bifluoride solution, 25% by weight in water | 16 |
| DEQUEST TM 2010 | 2 |
| Sulfuric acid | 1 |
| TRITON TM N 101 | 5 |

-continued

| Ingredient | Parts by Weight in Composition |
|---|---|
| Water | 942 |

EXAMPLE 4

The concentrate for this example had the following composition:

| Ingredient | Parts by Weight in Composition |
|---|---|
| Aluminum chloride | 10 |
| ETHFAC TM 136 | 50 |
| Ammonium bifluoride solution, 25% by weight in water | 11 |
| TRITON TM N101 | 6 |
| Citric acid | 6 |
| Ethoxylated alcohol surfactant | 11 |
| Water | 906 |

EXAMPLE 5

The concentrate for this example had the following composition;

| Ingredient | Parts by Weight in Composition |
|---|---|
| Fluorozirconic acid | 15 |
| Mono(hexyltriethoxy) phosphate | 70 |
| Poly(oxyethylene) isostearate with an average of 14 oxyethylene units per isostearate unit | 20 |
| Ammonium bifluoride solution, 25% by weight in water | 19 |
| Aminoacetic acid | 20 |
| Water | 856 |

EXAMPLE 6

The concentrate for this example had the following composition:

| Ingredient | Parts by Weight in Composition |
|---|---|
| Fluorozirconic acid | 15 |
| Mono(hexyltriethoxy) phosphate | 30 |
| ETHOX TM MI-14 | 20 |
| Ammonium bifluoride solution, 25% by weight in water | 15 |
| Butane-2-phosphonic acid tricarboxylate | 10 |
| Water | 910 |

EXAMPLE 7

The concentrate for this example had the following composition:

| Ingredient | Parts by Weight in Composition |
|---|---|
| Fluorozirconic acid | 10 |
| Polyoxyethylene isostearate containing an average of 14 moles of —$C_2H_4O$— groups per mole of isostearate | 10 |
| TRITON TM H-66 | 80 |
| DEQUEST TM 2010 | 2.5 |
| Ammonium bifluoride solution, 25% by weight in water | 4 |

-continued

| Ingredient | Parts by Weight in Composition |
|---|---|
| Water | 893.5 |

In the compositions given above, DEQUEST 2010 is a trade name for a material that is reported to be predominantly 1-hydroxyethylidene-1-diphosphonic acid, and TRITON N101 is a trade name for a surfactant material that is reported to be predominantly nonylphenoxypoly(ethoxy)ethanol, with an average of 9–10 ethoxy groups per molecule.

Table 1 shows the specific amounts of the concentrates used, treatment conditions, and the coefficients of static surface friction achieved on the can by sorption of a lubricant and surface conditioning layer for these examples.

TABLE 1

IMPROVEMENT IN SURFACE FRICTION FROM TREATMENT ACCORDING TO THIS INVENTION

| Experiment Number | % by Weight of Concentrate in Treatment Solution | Treatment Conditions: Temperature, Degrees C. | Treatment Conditions: Time, Seconds | Coefficient of Static Surface Friction |
|---|---|---|---|---|
| 1 | 1.0 | 35 | 20 | 1.27 |
| 2 | 1.0 | 35 | 20 | 1.47 |
| 3 | 1.0 | 35 | 20 | 1.31 |
| 4 | 1.0 | 35 | 20 | 0.77 |
| 5 | 1.0 | 35 | 20 | 0.77 |
| 6 | 1.0 | 35 | 20 | 1.20 |
| 7 | 1.0 | 35 | 20 | 1.01 |
| No treatment | | | | 1.67 |

EXAMPLE 8

This is an example of a composition that contains a preferred antifoam agent and a preferred biocide, but otherwise is according to the teachings of the '351 patent.

A first concentrate is prepared by mixing 880 parts by weight ("PBW") of ETHOX TM MI-14, 60 PBW of COLLOID 999 TM (a high molecular weight fatty acid derivative, available commercially from Colloids, Inc., 394 Frelinghuysen Ave., Newark, N.J. 07114, U.S.A.), and 60 PBW of GP-295 TM Defoamer (a suspension of about 10% solid wax in white mineral oil, available commercially from Genese Polymers Corp., Flint, Mich. 48507, U.S.A.). The ETHOX TM MI-14 is first melted in a mixing tank at 27°–32 ° C. The other two materials are then added in the order noted and mixed for form a cloudy but visually homogeneous liquid with no lumps.

A second concentrate suitable for storage for at least several months is then made by mixing 47 PBW of the first concentrate described above with 917 PBW of water, preferably deionized water, and with 40 PBW of 37.5% aqueous hydrogen peroxide. This second concentrate may then be diluted when desired to make a composition suitable for directly treating aluminum surfaces as generally described in the '351 patent.

EXAMPLES 9 AND 10

These examples illustrate preferred stabilized compositions including metal containing salts and ethoxylated phosphates. The compositions set forth in Table 2 below are concentrates, suitable for use in treating metal containers after being diluted with, e.g., 50–200 times their own weight of tap water.

TABLE 2

COMPOSITIONS FOR EXAMPLES 9 AND 10

| Ingredient | PBW in Example No.: 9 | 10 |
|---|---|---|
| Deionized water | 920 | 856 |
| ETHOX TM 2684 | 14 | 60 |
| TRITON TM DF-16 | 12 | — |
| TRYCOL TM LF-1 | 4 | 30 |
| IGEPAL TM CO-880 | 11 | 30 |
| DEQUEST TM 2010 | 3 | — |
| Ammonium bifluoride ($NH_4F.HF$) | 11 | 4 |
| Fluorozirconic acid ($H_2ZrF_6$) | 25 | 20 |

Sources and characterizations of ingredients in Table 2 not previously identified are as follows: ETHOX TM 2684, commercially available from Ethox Chemicals, Inc., Greenville, S.C. 20606, USA, corresponds to formula I with x and z both zero, $R^2$, $R^3$, and $R^5$ all representing hydrogen, $R^4$ representing a mixture of $C_{8-10}$ linear alkyl groups, and y averaging about 15. TRITON TM DF-16, commercially available from Rohm & Haas, Philadelphia, Pa. 19105, U.S.A., is reported to be a modified polyethoxylated straight chain alcohol. TRYCOL TM LF-1, commercially available from the Emery Chemical Division of Henkel Corporation, Cincinnati, Ohio 45249, U.S.A., is reported to be an alkyl polyether. IGEPAI TM CO-880, commercially available from GAF Corp, Wayne, N.J. 07470, U.S.A., is reported to be an ethoxylated nonyl phenol.

What is claimed is:

1. A process comprising steps of:

(a) cleaning the surface of an aluminum object having the shape and size intended for final use, by contacting the surface for an effective time with an aqueous based liquid cleaning composition having ingredients effective to produce a thoroughly degreased, clean surface substantially free from aluminum fines and other solid contamination;

(b) (i) rinsing the surface cleaned as recited in step (a) with additional water and (ii) drying the rinsed surface; and (c) conveying the object with a cleaned and dried surface produced as recited in steps (a) and b) via high speed automatic conveying equipment, wherein the improvement comprises contacting the aluminum surface after cleaning and rinsing as recited in steps (a) and (b)(i) but before the drying recited in step (b)(ii), with a liquid composition comprising water and the following components:

(A) a component of water soluble materials selected from the group conforming to general chemical formula I:

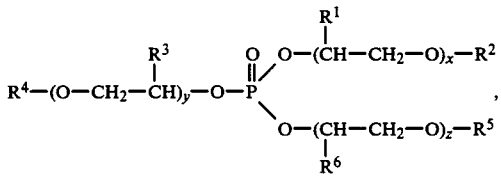

(I)

wherein each of $R^1$, $R^3$, and $R^6$ is independently selected from hydrogen and alkyl groups containing 1–about 4 carbon atoms each of x, y, and z is an integer and is independently selected within the range from 0–about 25; and each of $R^2$, $R^4$, and $R^5$ is independently selected from hydrogen, monovalent cations, monovalent fractions of polyvalent cations, alkyl groups containing 1–about 20 carbon atoms, and aryl and arylalkyl groups containing 1–about 20 carbon atoms, except that at least one of $R^2$, $R^4$, and $R^5$ (i) is not hydrogen and (ii) has at least one alkoxyl group bonded between it and the phosphorous atom in formula I;

(B) a component selected from the group of water soluble salts containing ions that comprise atoms selected from the group consisting of Fe, Zr, Sn, Al, and Ce;

(C) a water soluble metal etching component;

(D) a component selected from molecules conforming to general formula II:

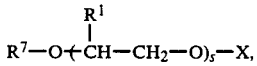

(II)

wherein $R^7$ is a linear, cyclic, or branched saturated monovalent aliphatic hydrocarbon moiety containing from 1 to 25 carbon atoms; X is selected from the group consisting of hydrogen, halogen, phenyl, and $R^1$; s is an integer from 1 to 50; and $R^1$ has the same meaning as for formula I; and (E) a component selected from molecules conforming to general formula III:

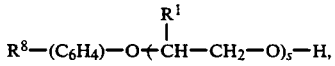

(III)

wherein $R^8$ is a linear, cyclic, or branched saturated monovalent aliphatic hydrocarbon moiety containing from 4 to 25 carbon atoms; $(C_6H_4)$ is an ortho, meta, or para phenylene nucleus; and $R^1$ and s have the same meaning as for formula II; and, optionally, (F) a component selected from chelating agents for the metal containing ions of component (B);

(G) a component selected from molecules conforming to general formula IV:

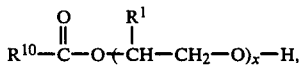

(IV)

wherein $R^{10}$ is a linear or branched, saturated or unsaturated monovalent aliphatic hydrocarbon moiety containing from 1 to 25 carbon atoms; and $R^1$ and x have the same meaning as in formula I;

the contacting of the aluminum surface with said liquid composition being at an effective temperature for a sufficient time to cause the coefficient of static surface friction of the aluminum object with the surface so treated to be less than 1.5, and the amount of components (D) and (E) present in said liquid composition being sufficient to stabilize the liquid composition against phase separation.

2. A process according to claim 1, wherein component (A) is selected from molecules according to formula I when each of $R^1$, $R^3$, and $R^6$ is hydrogen, each of x and z is zero, and y is not less than about 0.5 times the number of carbon atoms in $R^4$.

3. A process according to claim 2, wherein, in said liquid composition: (i) the concentration of phosphorus is in the range from about 0.00001 to about 0.0032 gram atoms per liter; (ii) the total concentration of all the metal atoms recited in component (B) is in the range from about 0.00001 to about 0.01 gram atoms per liter; (iii) the total concentration of components (A), (B), and (C) is between about 0.005 and about 0.05 w %; (iv) the pH is between about and about 5; and (v) the temperature during contacting the aluminum surface is between about 21° and about 54° C.

4. A process according to claim 1, wherein, in said liquid composition: (i) the concentration of phosphorus is in the range from about 0.00001 to about 0.0032 gram atoms per liter; (ii) the total concentration of all the metal atoms recited in component (B) is in the range from about 0.00001 to about 0.01 gram atoms per liter; (iii) the total concentration of components (A), (B), and (C) is between about 0.005 and about 0.05 w %; (iv) the pH is between about 2 and about 5; and (v) the temperature during contacting the aluminum surface is between about 21 and about 54° C.

5. A process according to claim 4, wherein the ratio by weight of component (D) to component (E) is in the range from about 3:1 to about 1:3 and the ratio by weight of the combined components (D) and (E) to component (A) is in the range from about 3.3:1 to about 1:2.

6. A process according to claim 3, wherein the ratio by weight of component (D) to component (E) is in the range from about 1.7:1 to about 1:1.4 and the ratio by weight of the combined components (D) and (E) to component (A) is in the range from about 1.8:1 to about 1:1.5.

7. A process according to claim 2, wherein the ratio by weight of component (D) to component (E) is in the range from about 1.7:1 to about 1:1.4 and the ratio by weight of the combined components (D) and (E) to component (A) is in the range from about 1.8:1 to about 1:1.5.

8. A process according to claim 1, wherein the ratio by weight of component (D) to component (E) is in the range from about 3:1 to about 1:3 and the ratio by weight of the combined components (D) and (E) to component (A) is in the range from about 3.3:1 to about 1:2.

9. A process according to claim 7, wherein component (D) is selected from molecules conforming to general formula II when $R^1$ is hydrogen, $R^7$ contains from 4–20 carbon atoms, and s is an integer from 1–20; and component (E) is selected from molecules conforming to general formula III when $R^1$ is hydrogen, $R^8$ contains from 8–12 carbon atoms, and s is an integer from 1–20.

10. A process according to claim 6, wherein component (D) is selected from molecules conforming to general formula II when $R^1$ is hydrogen, $R^7$ contains from 4–20 carbon atoms, and s is an integer from 1–20; and component (E) is selected from molecules conforming to general formula III when $R^1$ is hydrogen, $R^8$ contains from 8–12 carbon atoms, and s is an integer from 1–20.

11. A liquid composition of matter comprising water and the following components:

(A) a component of water soluble materials selected from the group conforming to general chemical formula I:

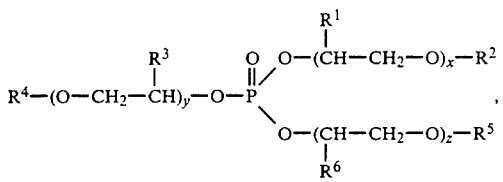

(I)

wherein each of $R^1$, $R^3$, and $R^6$ is independently selected from hydrogen and alkyl groups containing 1–about 4 carbon atoms each of x, y, and z is an integer and is independently selected within the range from 0–about 25; and each of $R^2$, $R^4$, and $R^5$ is independently selected from hydrogen, monovalent cations, monovalent fractions of polyvalent cations, alkyl groups containing 1–about 20 carbon atoms, and aryl and arylalkyl groups containing 1–about 20 carbon atoms, except that at least one of $R^2$, $R^4$, and $R^5$ is not hydrogen;

(B) a component selected from the group of water soluble salts containing ions that comprise atoms selected from the group consisting of Fe, Zr, Sn, Al, and Ce;

(C) a water soluble metal etching component;

(D) a component selected from molecules conforming to general formula II:

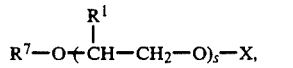

(II)

wherein $R^7$ is a linear, cyclic, or branched saturated monovalent aliphatic hydrocarbon moiety containing from 1 to 25 carbon atoms; X is selected from the group consisting of hydrogen, halogen, phenyl, and $R^1$; s is an integer from 1 to 50; and $R^1$ has the same meaning as for formula I; and (E) a component selected from molecules conforming to general formula III:

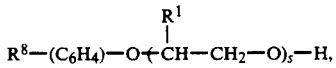

(III)

wherein $R^8$ is a linear, cyclic, or branched saturated monovalent aliphatic hydrocarbon moiety containing from 4 to 25 carbon atoms; $(C_6H_4)$ is an ortho, meta, or para phenylene nucleus; and $R^1$ and s have the same meaning as for formula II; and, optionally, (F) a component selected from chelating agents for the metal containing ions of component (B);

(G) a component selected from molecules conforming to general formula IV:

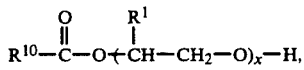

(IV)

wherein $R^{10}$ is a linear or branched, saturated or unsaturated monovalent aliphatic hydrocarbon moiety containing from 1 to 25 carbon atoms; and $R^1$ and x have the same meaning as in formula I.

12. A liquid lubricant and surface conditioner composition for application to at least one exterior surface of a cleaned aluminum can to improve the mobility of the can when conveyed, said composition consisting essentially of a solution of water and:

(A) water-soluble ethoxylated organic material selected from the group consisting of ethoxylated fatty acids, salts of ethoxylated fatty acids, ethoxylated alcohols having at least 4 carbon atoms and containing up to about 20 moles of condensed ethylene oxide per mole of alcohol, ethoxylated alkyl alcohol phosphate esters, and mixtures thereof; and (B) an amount of hydrogen peroxide effective to prevent deterioration of the composition by the action of microorganisms, said liquid lubricant and surface conditioner composition having a pH of between about 1 and about 6.5 and forming a film on the can surface when applied thereto and dried, thereby reducing the coefficient of static friction of said surface.

13. A composition according to claim 12 having a pH between about 2.5 and about 5 and additionally comprising a foam reducing effective amount of a mixture of solid wax, liquid paraffin, and high molecular weight fatty acid derivative molecules.

14. A process comprising the steps of cleaning an aluminum can with an aqueous acidic or alkaline cleaning solution, drying the cleaned can, and subsequently conveying the cleaned and dried can via automatic conveying equipment to a location where it is lacquered or decorated by printing or both, wherein the improvement comprises contacting at least one exterior surface of said aluminum can, prior to the last drying of said exterior surface before automatic conveying, with a lubricant and surface conditioner composition containing an amount of biocidal material effective to prevent deterioration of the lubricant and surface conditioner composition during storage or use, thereby forming a film on the can surface to provide the surface of the can after drying with a coefficient of static friction that is not more than 1.5 and that is less than would be obtained on a can surface of the same type without such film coating.

15. A process according to claim 14, wherein said lubricant and surface conditioner composition is an aqueous solution consisting essentially of a solution of water, hydrogen peroxide, and dissolved organic material selected from the group consisting of ethoxylated phosphate esters; ethoxylated alcohols; ethoxylated fatty acids; ethoxylated hydroxy substituted fatty acids; salts, amides, ethers, and esters of ethoxylated fatty acids and of ethoxylated hydroxy substituted fatty acids; and mixtures thereof.

16. A process according to claim 15 wherein the lubricant and surface conditioner composition has a pH between about 1 and about 6.5, the lubricant and surface conditioner composition contains an antifoam agent in sufficient amount to reduce foaming during the process to a lower level than would occur during identical use of a lubricant and surface conditioner reference composition in which water replaced the antifoam agent, and the dissolved organic material is selected from the group consisting of ethoxylated fatty acids, salts of ethoxylated fatty acids, ethoxylated alcohols having at least 4 carbon atoms and containing up to about 20 moles of condensed ethylene oxide per mole of alcohol, ethoxylated alkyl alcohol phosphate esters, and mixtures thereof.

17. A process according to claim 14 wherein the lubricant and surface conditioner composition has a pH between about 1 and about 6.5, the lubricant and surface conditioner composition contains an antifoam agent in sufficient amount to reduce foaming during the process to a lower level than would occur during identical use of a lubricant and surface conditioner reference composition in which water replaced the antifoam agent, and the dissolved organic material is selected from the group consisting of ethoxylated fatty acids, salts of ethoxylated fatty acids, ethoxylated alcohols having at least 4 carbon atoms and containing up to about 20 moles of condensed ethylene oxide per mole of alcohol, ethoxylated alkyl alcohol phosphate esters, and mixtures thereof.

18. A process according to claim 17 wherein the antifoam agent is a mixture of solid wax, liquid paraffin, and high molecular weight fatty acid derivative molecules.

19. A process according to claim 16 wherein the antifoam agent is a mixture of solid wax, liquid paraffin, and high molecular weight fatty acid derivative molecules.

20. A process comprising the steps of cleaning an aluminum can with an aqueous acidic or alkaline cleaning solution, drying the cleaned can, and subsequently conveying the cleaned and dried can via automatic conveying equipment to a location where it is lacquered or decorated by printing or both, wherein the improvement comprises contacting at least one exterior surface of said aluminum can, prior to the last drying of said exterior surface before automatic conveying, with a lubricant and surface conditioner composition containing an antifoam agent in sufficient amount to reduce foaming during the process to a lower level than would occur during identical use of a lubricant and surface conditioner reference composition in which water replaced the antifoam agent, thereby forming a film on the can surface to provide the surface of the can after drying with a coefficient of static friction that is not more than 1.5 and that is less than would be obtained on a can surface of the same type without such film coating.

* * * * *